US006055919A

United States Patent [19]

Janouschek

[11] Patent Number: 6,055,919

[45] Date of Patent: May 2, 2000

[54] SPOOL CAPSULE FOR A SEWING MACHINE

[75] Inventor: Heinz Janouschek, Steckborn, Switzerland

[73] Assignee: Fritz Gegauf AG Bernina-Nahmaschinenfabrik, Steckborn, Switzerland

[21] Appl. No.: 09/299,135

[22] Filed: Apr. 26, 1999

[30] Foreign Application Priority Data

Apr. 29, 1998 [CH] Switzerland ..... 00969/98

[51] Int. Cl.[7] ..... D05B 57/26

[52] U.S. Cl. ..... 112/231

[58] Field of Search ..... 112/231, 228, 112/229, 232, 181, 184

[56] References Cited

U.S. PATENT DOCUMENTS

| | | | |
|---|---|---|---|
| 2,212,475 | 8/1940 | Karle | 112/231 |
| 3,232,258 | 2/1966 | Gegauf, Jr. | 112/228 |
| 4,303,029 | 12/1981 | Bianchi | 112/231 |

*Primary Examiner*—Peter Nerbun
*Attorney, Agent, or Firm*—Edwin D. Schindler

[57] ABSTRACT

A spool capsule for a sewing machine for receiving a lower thread spool, having a concentrically disposed bore for mounting the spool capsule on a spool carrier pin, with a spring, serving as a locking device for axially retaining the spool capsule on the spool carrier pin, being inserted into a spool receiving space of the spool capsule. A section of the spring is constructed so that it is elastically displaceable radially, relative to the concentrically disposed bore, penetrating the bore in a manner analogous to a tendon. The locking device includes only a single movable element, which serves for both arresting the spool capsule on the pin of the spool and as an actuating device. This single element includes a spring, which is retained in a centrally-extending groove in a deepening of the spool capsule, and projects outwardly, at one point, through an opening in the surface of the spool capsule. The spring, preferably, has a round wire, which first extends through a multiple bending along the periphery of the central groove of the spool capsule and, then, in one section, tangentially traverses the bore in the spool capsule in order to subsequently exit though an opening partly beyond the surface of the spool capsule.

15 Claims, 2 Drawing Sheets

SPOOL CAPSULE FOR A SEWING MACHINE

BACKGROUND OF THE INVENTION

1. Technical Field of the Invention

The present invention relates, generally, to a spool capsule for a sewing machine.

More particularly, the present invention relates to a spool capsule for a sewing machine for receiving a lower thread spool, having a concentrically disposed bore for mounting the spool capsule on a spool carrier pin, with a spring, serving as a locking device for axially retaining the spool capsule on the spool carrier pin, being inserted into a spool receiving space of the spool capsule. A section of the spring is constructed so that it is elastically displaceable radially, relative to the concentrically disposed bore, penetrating the bore in a manner analogous to a tendon.

2. Description of the Prior Art

With most conventional sewing machines designed for producing a so-called double-quilt stitch seam, the thread spool containing the lower thread supply is supported in a spool capsule. The spool capsule is rotatably supported on a central pin on a catcher or on a spool carrier, depending upon the construction of the catcher. A locking device on the spool capsule retains the latter on the pin of the catcher or spool carrier. The locking device, which is mounted on the bottom of the spool capsule, includes a plurality of movable components. A radially movable pawl engages an annular groove at the end of the pin, under the biassing pressure of a spring, and, in this manner, thereby secures the spool capsule against axial movement.

Such a conventional spool capsule is shown and described, e.g., in U.S. Pat. No. 3,232,258. A locking device on a spool capsule, with a radially movable pawl, is disclosed in Switzerland Patent No. 395,711. In Switzerland Patent No. 569,822, the locking device consists of a pawl, as well, which is displaceable vertically to the central axis of the pin of the spool carrier beyond the center point of the spool capsule.

Such conventional spool capsules, or locking devices, serve their purposes in an adequate manner. However, such prior art devices have the drawback that their manufacture requires an extremely high expenditure resulting from the need to manufacture a plurality of components which, furthermore, have to be produced with high precision. Moreover, a mounting of the locking device is complicated because the individual components are very small and their assembly and adjustment is, consequently, highly labor-intensive. An additional drawback is that the locking device requires much space and, accordingly, unnecessarily limits, in the spool capsule, the space available for the lower thread supply, i.e., for the lower thread spool.

SUMMARY OF THE INVENTION

It is, therefore, an object of the present invention to provide a spool capsule with a locking device for a sewing machine, having low space requirements and low manufacture requirements with respect to the precision required in the manufacture of the individual components thereof.

It is further object of the present invention to provide a spool capsule with a locking device for a sewing machine which overcomes the disadvantages inherent in comparable sewing machines presently known to the prior art.

The foregoing and related objects are achieved by a spool capsule for a sewing machine for receiving a lower thread spool, having a concentrically disposed bore for mounting the spool capsule on a spool carrier pin, with a spring, serving as a locking device for axially retaining the spool capsule on the spool carrier pin, being inserted into a spool receiving space of the spool capsule. A section of the spring is constructed so that it is elastically displaceable radially, relative to the concentrically disposed bore, penetrating the bore in a manner analogous to a tendon.

More specifically, the locking device of the presently claimed invention comprises only a single movable element, which serves as both the means for arresting the spool capsule on the pin of the spool and as the actuating means. This single element includes a spring, which is retained in a centrally-extending groove in a deepening of the spool capsule, and projects outwardly, at one point, through an opening in the surface of the spool capsule. The spring, preferably, comprises a round wire, which first extends through a multiple bending along the periphery of the central groove of the spool capsule and, then, in one section, tangentially traverses the bore in the spool capsule in order to subsequently exit though an opening partly beyond the surface of the spool capsule.

The section of the spring exiting beyond the spool capsule does not, in any way, obstruct the loop of the upper thread pulled over the spool capsule as the stitch is being formed. The spring is disposed in a deepening within the face side of the spool capsule and takes up very little space which, moreover, is not usable for the thread spool; thus, the axial length of the space receiving the thread spool is enlarged versus designs known to the prior art. The result is that a larger, lower thread spool can be employed that may accommodate a greater quantity of thread, of up to 50%. A higher sewing capacity, or longer sewing time, of up to 50% is consequently achieved between two changes of the lower thread.

Other objects and features of the present invention will become apparent when considered in combination with the accompanying drawing figures which illustrate certain preferred embodiments of the present invention. It should, however, be noted that the accompanying drawing figures are intended to illustrate only certain embodiments of the claimed invention and are not intended as a means for defining the limits and scope of the invention.

BRIEF DESCRIPTION OF THE DRAWING FIGURES

In the drawing, wherein similar reference numerals denote similar features throughout the several views.

DETAILED DESCRIPTION OF THE DRAWING FIGURES AND PREFERRED EMBODIMENTS

Figure 1:
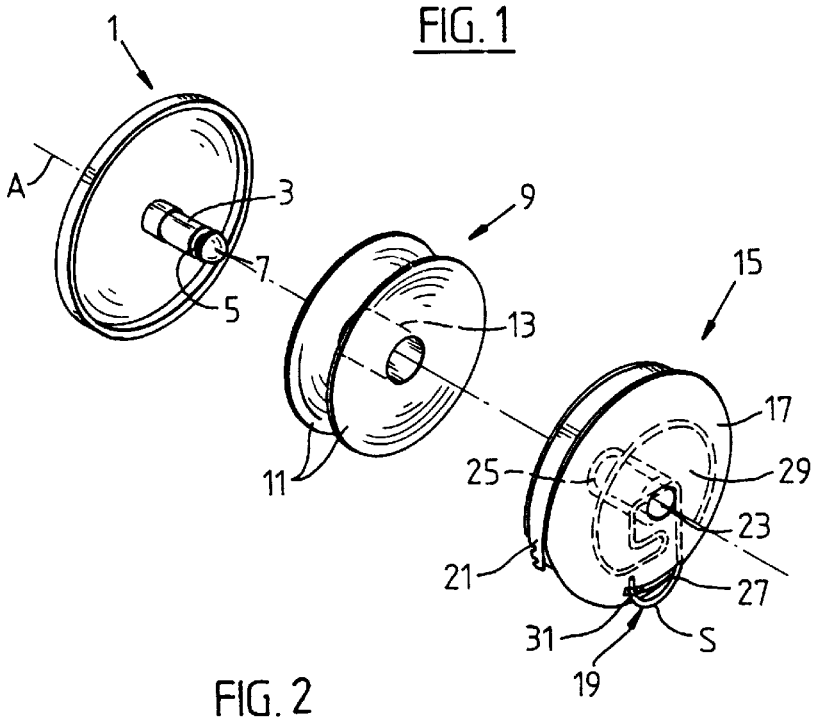
FIG. 1 is a perspective, schematic representation of the pin of the spool carrier, the spool and a spool capsule of the present invention.

Turning now, in detail, to the accompanying drawing figures, in FIG. 1, a catcher system 1 (which is not shown in greater detail, because it is a feature known to the state of the art), along with a spool carrier pin 3, is shown having a groove 5 extending all around said spool carrier pin.

Spool carrier pin 3 has a circular cross-section and an end 7, preferably, has the shape of a mushroom, or an otherwise rounded form. A spool 9, for a lower thread, comprises two flanges 11, which are connected with each other by a hollow shaft 13.

Reference numeral 15 denotes a spool capsule, which comprises a dish 17 with a spool receiving space 18, a locking spring 19 (for convenience, otherwise referred to as "spring 19"), and a thread tensioning spring 21 acting as a thread brake. A circular bore 23 is provided in the center of rotation with axis "A" of dish 17; said bore being adjoined in interior 18 of dish 17 by a tubular hub 25. A loop-shaped section 27 of spring 19 penetrates the face 29 of dish 17, within an opening 31 provided in said dish, and serves as a pressure piece for actuating spring 19.

Figure 2:
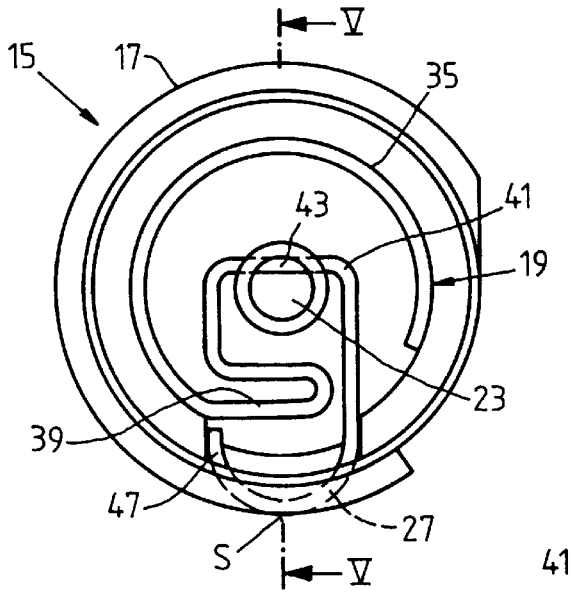
FIG. 2 is a top view of a preferred embodiment of the interior of the spool capsule of the present invention.
Figure 5:
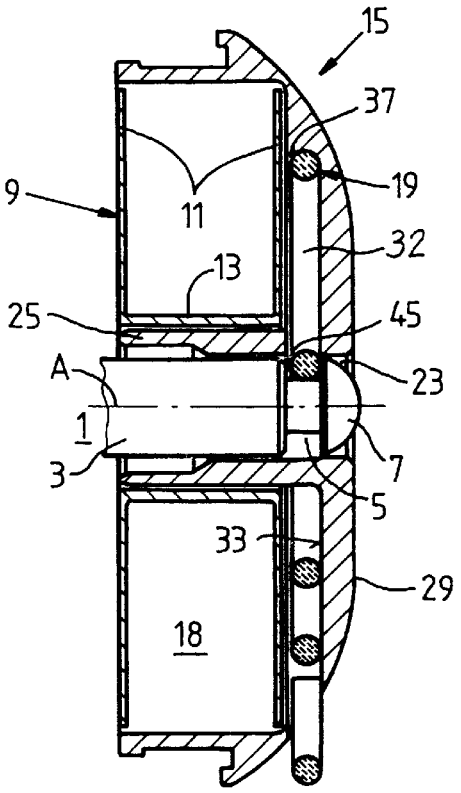

In a first, preferred embodiment of the present invention, as illustrated in FIG. 2, spring 19, forming the locking means, is disposed in an undercut deepening 32, where it rests against backside 33 of face 29, in the interior 18 of dish 17. The first section 35 of spring 19, which extends over more than 180° of angle in the form of a circle, is partly disposed in a groove 37 extending all around; said groove being formed by the undercut, and is immovably retained in said groove by its own clamping force. A second section 39, in the form of a "U"-shape, adjoins the first section 35 of spring 19, and said second section is followed by a substantially right-angled third section 41; the first leg 43 of which penetrates the bore 23 of a hub 25 in a manner analogous to a chord. In order to permit penetration of hub 25, the latter has a lateral cut 45 within the zone of backside 33 of dish 17 (see, FIG. 5.)

The third section 41 of spring 19 is adjoined by a further U-shaped section, i.e., fourth section 47, with apex "S" of said section penetrating opening 31. Spring 19, inserted in spool capsule 15, is under tension, i.e., in the relieved state, and first section 35 has a larger diameter than groove 37, so that said spring rests against groove 37 with its first section 35, and is retained in this way, whereas the third section 41 is pulled into recess 45. The fourth section 47, at the same time, projects beyond face 29 of spool capsule 15 with its apex "S."

Figure 3:
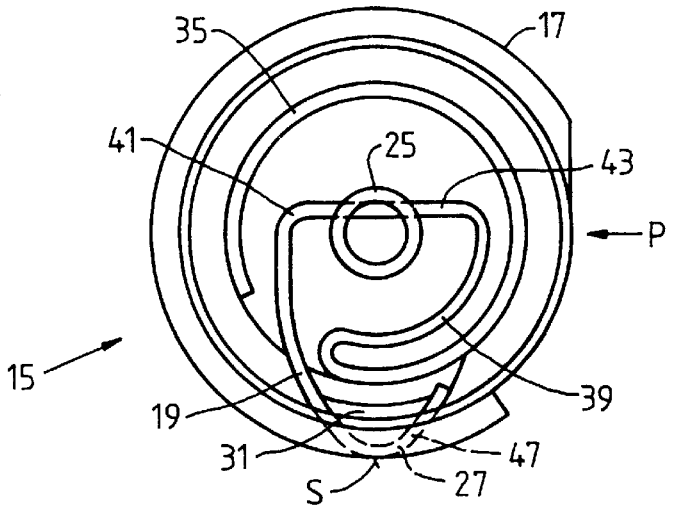
FIG. 3 is a top view of an alternative, preferred embodiment of the interior of the spool capsule of the present invention.
Figure 4:
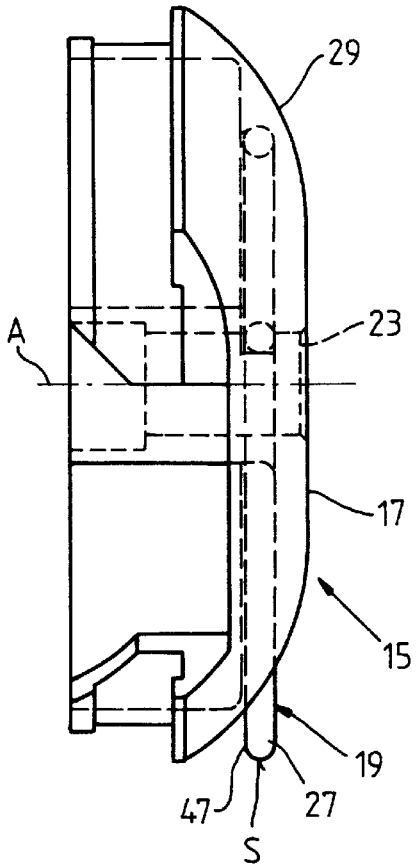
FIG. 4 is a side view of the spool capsule viewed from the direction indicated by arrow "P" of FIG. 3; and, FIG. 5 is a cross-section view, taken along the line V—V of FIG. 2, through the spool capsule thereof.

In a second, preferred embodiment of the present invention, as illustrated in FIG. 3, the second section 39 does not extend in the form of a "U," but has circular legs. However, the effect of second section 39 is the same.

Thread-tensioning spring 21, as shown in FIG. 1, is not herein being explained in greater detail, because its function is known from the state of the art and because said spring 21 is not, per se, part of the invention.

When spool capsule 15, with spool 9 previously inserted therein, is mounted on spool carrier pin 3, section 43 of spring 19, penetrating hub 25, is briefly pushed radially sideways by end 7—e.g., which is rounded in the form of a mushroom—and subsequently comes to rest in annular groove 5, and thereby axially retains spool capsule 15 with spool 9 inserted in the latter. Spool 9, itself, is freely rotatable on hub 25 and spool carrier pin 3 is rotatably disposed in bore 23 of hub 25.

For manually removing spool capsule 15, after the thread on spool 9 has been consumed, or for changing the type of thread, the fourth section 47 of spring 19 has to be pushed radially inwardly with the user's finger. This displaces the third section 41 with leg 43 (which is extending straight) from groove 5 of hub 25, thereby releasing the axial lock of spool capsule 15 on spool carrier pin 3.

While only several embodiments of the present invention have been shown and described, it will be obvious to those skilled in the art that many modifications may be made to the present invention without departing from the spirit and scope thereof.

What is claimed is:

1. A spool capsule arrangement for a sewing machine, comprising:

a spool carrier pin of a catcher system;

a lower thread spool having a concentrically disposed bore;

a spool capsule having a spool receiving space for receiving said lower thread spool on said spool carrier pin, said spool carrier pin passing through the concentrically disposed bore of said lower thread spool, said spool capsule further comprising a dish having a circular bore provided in a center of rotation of said dish; and, a locking device for axially retaining said spool capsule on said spool carrier pin, said locking device being a spring that is inserted in said spool receiving space of said spool capsule, said spring having a first section being retained by said dish of said spool capsule, a second section being formed between said first section and a third section of said spring, said second section having means for increasing the elasticity of said spring, and said third section of said spring being constructed so that it is elastically displaceable radially relative to the circular bore of said dish of said spool capsule, said third section penetrating the circular bore.

2. A spool capsule arrangement for a sewing machine according to claim 1, wherein said spool receiving space includes a deepening having a circumferential groove, with said first section of said spring being insertable in said groove.

3. A spool capsule arrangement for a sewing machine according to claim 1, wherein said third section of said spring comprises a locking section extending in a straight line, said locking section being structured for engaging a groove extending around on said spool carrier pin.

4. A spool capsule arrangement for a sewing machine according to claim 1, wherein said spool capsule includes a tubular hub having a jacket and a tangential cut therein engaged by said third section of said spring.

5. A spool capsule arrangement for a sewing machine according to claim 1, wherein said spring includes a fourth section adjoining said third section, said fourth section having a curved shape and forming an apex therefor, said apex of said fourth section penetrating said dish of said spool capsule though an opening provided in said dish and serving as an actuating device.

6. A spool capsule arrangement for a sewing machine, comprising:

a spool carrier pin of a catcher system;

a lower thread spool having a concentrically disposed bore;

a spool capsule having a spool receiving space for receiving said lower thread spool on said spool carrier pin, said spool carrier pin passing through the concentrically disposed bore of said lower thread spool, said spool capsule further comprising a dish having a circular bore provided in a center of rotation of said dish; and, a locking device for axially retaining said spool capsule on said spool carrier pin, said locking device being a spring that is inserted in said spool receiving space of said spool capsule, said spring having a first section being retained by said dish of said spool capsule, a second section having a U-shape and being formed between said first section and a third section of said spring, said second section being capable of increasing the elasticity of said spring, and said third section of said spring being constructed so that it is elastically displaceable radially relative to the circular bore of said dish of said spool capsule, said third section penetrating the circular bore.

7. A spool capsule arrangement for a sewing machine according to claim 6, wherein said spool receiving space includes a deepening having a circumferential groove, with said first section of said spring being insertable in said groove.

8. A spool capsule arrangement for a sewing machine according to claim 6, wherein said third section of said spring comprises a locking section extending in a straight line, said locking section being structured for engaging a groove extending around on said spool carrier pin.

9. A spool capsule arrangement for a sewing machine according to claim 6, wherein said spool capsule includes a tubular hub having a jacket and a tangential cut therein engaged by said third section of said spring.

10. A spool capsule arrangement for a sewing machine according to claim 6, wherein said spring includes a fourth section adjoining said third section, said fourth section having a curved shape and forming an apex therefor, said apex of said fourth section penetrating said dish of said spool capsule though an opening provided in said dish and serving as an actuating device.

11. A spool capsule arrangement for a sewing machine, comprising:

a spool carrier pin of a catcher system;

a lower thread spool having a concentrically disposed bore;

a spool capsule having a spool receiving space for receiving said lower thread spool on said spool carrier pin, said spool carrier pin passing through the concentrically disposed bore of said lower thread spool, said spool capsule further comprising a dish having a circular bore provided in a center of rotation of said dish; and, a locking device for axially retaining said spool capsule on said spool carrier pin, said locking device being a spring that is inserted in said spool receiving space of said spool capsule, said spring having a first section being retained by said dish of said spool capsule, a second section having a circular legs and being formed between said first section and a third section of said spring, said second section being capable of increasing the elasticity of said spring, and said third section of said spring being constructed so that it is elastically displaceable radially relative to the circular bore of said dish of said spool capsule, said third section penetrating the circular bore.

12. A spool capsule arrangement for a sewing machine according to claim 11, wherein said spool receiving space includes a deepening having a circumferential groove, with said first section of said spring being insertable in said groove.

13. A spool capsule arrangement for a sewing machine according to claim 11, wherein said third section of said spring comprises a locking section extending in a straight line, said locking section being structured for engaging a groove extending around on said spool carrier pin.

14. A spool capsule arrangement for a sewing machine according to claim 11, wherein said spool capsule includes a tubular hub having a jacket and a tangential cut therein engaged by said third section of said spring.

15. A spool capsule arrangement for a sewing machine according to claim 11, wherein said spring includes a fourth section adjoining said third section, said fourth section having a curved shape and forming an apex therefor, said apex of said fourth section penetrating said dish of said spool capsule though an opening provided in said dish and serving as an actuating device.

* * * * *